US006851836B2

(12) United States Patent
Chou

(10) Patent No.: US 6,851,836 B2
(45) Date of Patent: Feb. 8, 2005

(54) COLLAPSIBLE LAMPSHADE

(76) Inventor: Hsih Bin Chou, 6391 Oceanus Dr., Huntington Beach, CA (US) 92649

( * ) Notice: Subject to any disclaimer, the term of this patent is extended or adjusted under 35 U.S.C. 154(b) by 0 days.

(21) Appl. No.: 10/615,496

(22) Filed: Jul. 8, 2003

(65) Prior Publication Data

US 2005/0007787 A1 Jan. 13, 2005

(51) Int. Cl.[7] ..... F21V 1/06; F21V 11/00

(52) U.S. Cl. ..... 362/352; 362/357; 362/358; 362/360; 362/361; 362/434; 362/450

(58) Field of Search ..... 362/352, 255, 362/351, 353, 355, 356, 357, 358, 360, 361, 433, 434, 435, 450

(56) References Cited

U.S. PATENT DOCUMENTS 6,315,434 B1 * 11/2001 Long ..... 362/352
6,517,220 B2 * 2/2003 Wu ..... 362/352
6,540,383 B2 * 4/2003 Wu ..... 362/450
6,698,910 B2 * 3/2004 Wu ..... 362/352

* cited by examiner

*Primary Examiner*—Stephen Husar
*Assistant Examiner*—Sharon Payne
(74) *Attorney, Agent, or Firm*—ZITO tlp; Joseph J. Zito; Kendal M. Sheets

(57) ABSTRACT

A lamp shade which can be folded to reduce its size for shipping, display and storage, having an upper ring, a lower ring, and a number of supports interconnecting, separating and supporting the upper and lower rings. In one embodiment, the supports are separate trapezoid-shaped single piece supports which are disconnected from the rings for collapsing the lampshade. In another embodiment, the supports are separate U-shaped single piece supports which are disconnected from the rings for collapsing the lampshade. In another embodiment, the supports are U-shaped single piece supports loosely attached to the upper ring of the lampshade at the center of each support and which are disconnected from the lower ring for collapsing the lampshade.

10 Claims, 7 Drawing Sheets

COLLAPSIBLE LAMPSHADE

RELATED APPLICATIONS

This application is related to U.S. application Ser. No. 10/274,699 filed Oct. 18, 2002.

FIELD OF THE INVENTION

The present invention relates to lampshade frames which are covered with a flexible material and can be collapsed to occupy less space during shipping and storage. More specifically, the present invention is a collapsible lampshade with an upper ring, a mounting hub and a lower ring and removable supports between the upper and lower rings.

BACKGROUND OF THE INVENTION

A significant part of the sales price of a table lamp arises from the cost of transporting the lamp from the manufacturing plant to the retail sales store or to the purchaser and the cost for inventory space, shelf space and storage space. Because the shade often forms a substantial portion of the lamp's total packaging volume, the shade disproportionately affects the shipping, display and storage cost and ultimately the sales price of the lamp. The present invention is designed to overcome this shortcoming by providing an inexpensive and collapsible shade structure. During shipment, storage and display, the shade may be collapsed to minimize its packaging volume, thereby reducing the lamp's size and cost.

SUMMARY OF THE INVENTION

A collapsible lampshade is disclosed having an upper ring, a lower ring, and a number of supports interconnecting and spacing apart the upper and lower rings. The lampshade also has a flexible cover, such as cloth, fabric or paper attached to the upper and lower rings. The supports are removed from the shade to allow the shade to be collapsed. In an alternate exemplary embodiment, each of the supports is attached to the upper ring in a manner that facilitates assembly and disassembly without separating the supports from the lampshade. Holes in the supports are penetrated by struts in the upper ring such that the supports may be slid along the struts to collapse the lampshade and returned back into place to space the rings and provide support and shape to the lampshade cover.

In a first exemplary embodiment, as shown in FIGS. 2A, 2B, 3A, 3B and 3C, the supports are rectangular or trapezoid-shaped. The supports have two curved ends and two straight sides. The curved ends are curved to match the upper and lower rings. One curved end is placed against either the upper or the lower ring. Next, the opposite end is placed against the other ring. The supports are held in place by the tension of the cover. The straight sides of the supports hold the upper and lower rings parallel and spaced apart to form the frame structure for the shade. The supports are not attached to either ring. The supports are removed from both rings prior to collapsing and shipping the lampshade. When collapsed for shipping, the lampshade has four separate pieces, the two rings with the attached cover are one piece and each of the three supports are separate, unattached pieces.

In a second exemplary embodiment, as shown in FIGS. 4A–4C and 5A–5D, the supports are U-shaped with one end and two straight sides. The end of each support is curved to match the upper ring. The curved end is first placed against the upper ring. Next, the ends of the two legs of each support are pressed upward and inward. The ends of the supports are then aligned with boots on the lower ring and are inserted into the boots and released. The supports hold the upper and lower rings parallel and spaced apart to form the frame structure for the shade. The supports are not attached to either ring, in the exemplary embodiment as illustrated. However, the ends of the supports can be fixed in the boots, allowing the supports to pivot flat without being removed from the lower ring. The supports are removed from both rings prior to collapsing and shipping the lampshade. When collapsed for shipping, the lampshade has four separate pieces, the two rings and the cover are one piece and each of the three supports are separate unattached pieces, unless the supports remain connected to the lower ring.

In a third exemplary embodiment, as shown in FIGS. 6A–6C and 7A–7D, the supports are U-shaped with one end and two straight sides. The end of each support is curved to match the upper ring. The center of the curved end is flattened and contains a hole which is penetrated by a strut of the upper ring. The curved end is first slid along the strut to the outer end of the strut and placed against the upper ring. Next, the ends of the two legs of each support are pressed upward and inward. The ends of the supports are then aligned with sockets on the lower ring and are inserted into the sockets and released. The supports hold the upper and lower rings parallel and spaced apart to form the frame structure for the shade. The supports are connected to the upper ring but are not attached to the lower ring. The supports are removed from the lower rings prior to collapsing the lampshade and then adjusted to a flat position by pivoting, sliding along and rotating around the strut as desired after the lampshade cover is collapsed and prior to shipping the lampshade. When collapsed for shipping, the lampshade has only one piece comprised of the two rings and attached cover and each of the three supports connected to the upper ring at the struts.

In the illustrated exemplary embodiments, three supports are utilized to interconnect the upper ring and the lower ring, however a lesser or a greater number can be used without departing from the teachings of the present invention. Also in illustrated exemplary embodiments, boots and sockets are shown associated with a particular support style. Either boots or sockets or any other type of device known to those skilled in the art may be used with either style of support to fix the bottom of the supports against the lower ring without departing from the teachings of the present invention.

BRIEF DESCRIPTION OF THE DRAWINGS

Exemplary embodiments of the invention are discussed hereinafter in reference to the drawings, in which.

DETAILED DESCRIPTION OF PREFERRED EXEMPLARY EMBODIMENTS

Figure 1A:
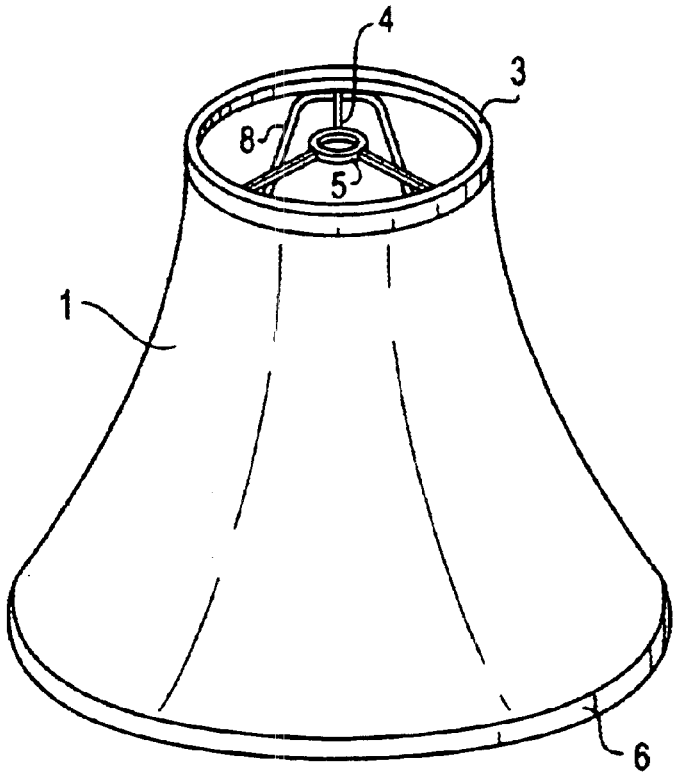
FIG. 1A a side view of the outside of the lampshade of the present invention fully assembled. The intermediate support is generally depicted in the assembled position.
Figure 1B:
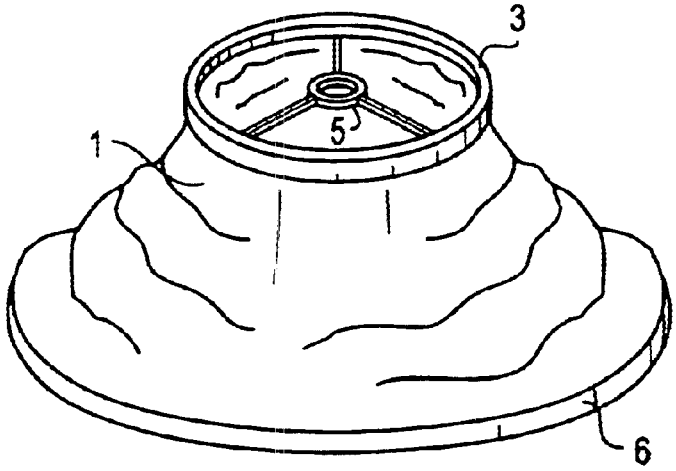
FIG. 1B is a side view of the outside of the lampshade of the present invention, disassembled and partially folded. The lampshade is generally depicted without intermediate supports, which in the first and second exemplary embodiments are removed from the lampshade and in the third exemplary embodiment are folded flat beneath lower ring after the shade is collapsed.

In each of the exemplary embodiments of the lampshade of the present invention, as illustrated in FIGS. 1A and 1B, the lampshade has a frame and a cover 1.

Figure 2A:
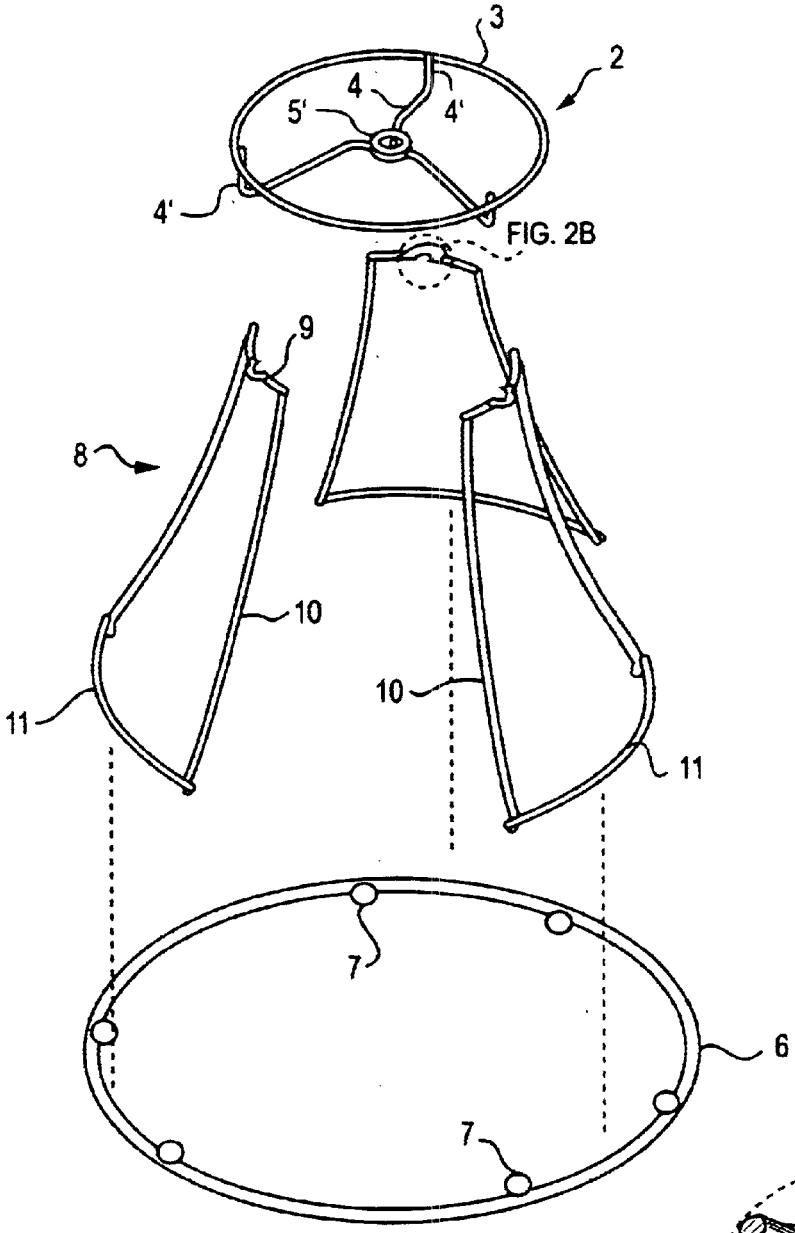
FIG. 2A is an assembly view of the structure of the first exemplary embodiment of the lampshade. The cover is omitted for clarity.
Figure 2B:
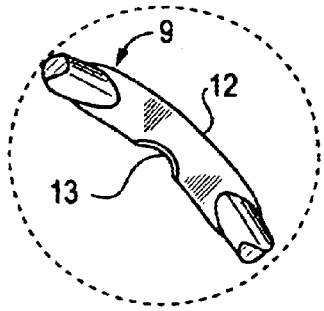
FIG. 2B is a view of the flattened portion 12 at the center of the circumferential yoke 9 with centering notch 13 of the first exemplary embodiment of the lampshade.
Figure 3A:
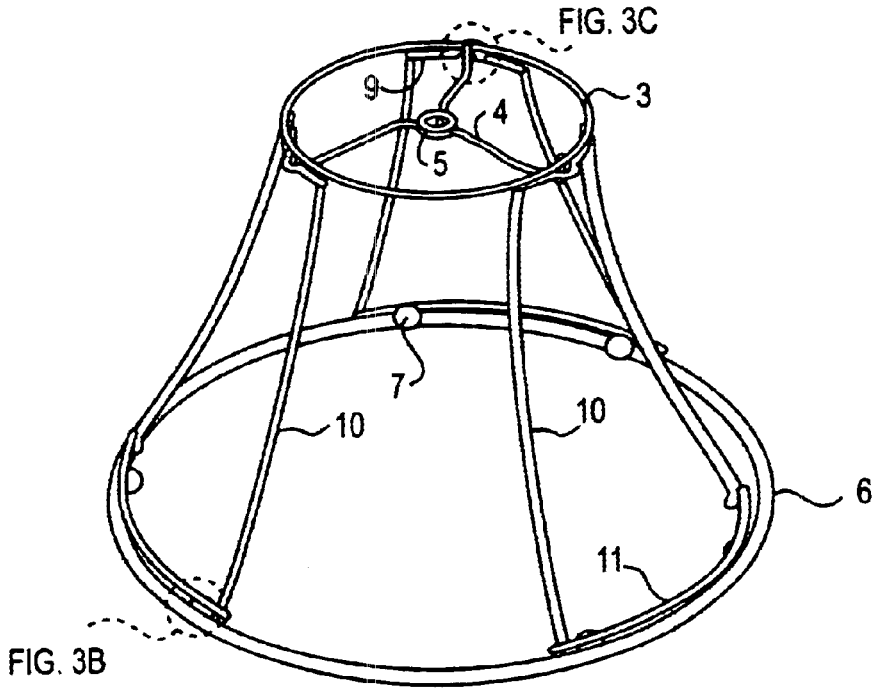
FIG. 3A is a view of the structure of the first exemplary embodiment of the lampshade fully assembled. The cover is omitted for clarity.

As illustrated in FIGS. 2A and 3A, the first embodiment of the frame has five separate components: an upper assembly 2 comprised of upper ring 3, struts 4 and mounting hub 5, a lower ring 6 with retaining nubs 7, and three intermediate supports 8, each comprised of one circumferential yoke 9, two vertical ribs 10 and one lower circumferential base 11. The struts 4 extend generally horizontally outward from hub 5, with a vertical portion 4' at the outer end which is connected to ring 3. The frame is preferably metal but can be made of any other suitable stiff material. The lampshade also includes a cover 1 as depicted in FIG. 1A, which can be made of any suitable flexible material such as cloth, fabric or paper. As illustrated in FIG. 1A, cover 1 is attached to upper ring 3 and lower ring 6. The mounting hub 5 is provided so that the lampshade can be carried on a standard lamp base in the manner common for table lamps, floor lamps and other lamps having shades.

The upper circumferential yoke 9 is comprised of a generally cylindrical bar, curved to the radius of the upper ring 3 with a portion of its length at the center 12 flattened in a plane coincident with the plane of the arc of the yoke 9 itself. A notch 13 is cut into the center of the inner edge of the flattened portion of the bar as is shown in FIG. 2A. This notch serves as a guide for centering and then stabilizing the intermediate support 8 during assembly.

Figure 3B:
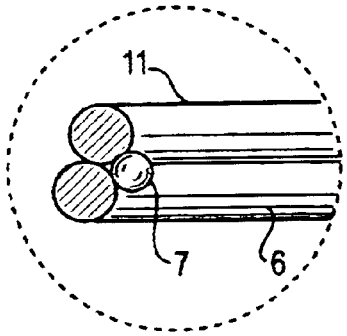
FIG. 3B is a view of the circumferential base 11 of the intermediate support of the first exemplary embodiment in position against the lower ring 6 held in place by a retaining nub 7 after assembly.
Figure 3C:
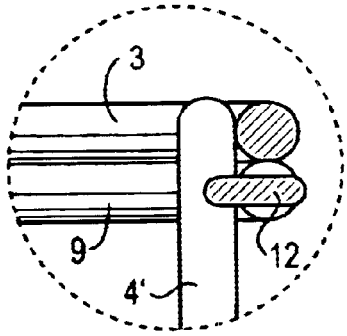
FIG. 3C is a view of the central portion 12 of the circumferential yoke 9 of the intermediate support of the first exemplary embodiment in position against the upper ring 3, held in place by the vertical portion 4' of strut 4 after assembly.

Each of the intermediate supports 8 is trapezoidal-shaped. To assemble the lampshade, each of the three intermediate supports 8 are placed in position between the upper and lower rings 3 and 6, as illustrated in FIG. 3A. To install each intermediate support 8, first the upper circumferential yoke 9 of the support is placed against the lower surface of upper ring 3, as illustrated in FIG. 3A, with notch 13 aligned with the vertical portion 4' of strut 4. Next, the lower circumferential base 11 of the support is pressed between nubs 7 and loop 6 as illustrated in FIG. 3B. The centers of each lower circumferential base 11 are aligned approximately below the centers of the corresponding upper circumferential yoke 9 as illustrated. The supports are held in place by the tension of the cover 1. The intermediate supports 8 hold the upper and lower rings 3 and 6 parallel and spaced apart to form the frame structure for the shade. The intermediate supports 8 are not attached to either ring but are simply held in place by being wedged against the rings. The supports are removed from both rings prior to collapsing and storing or shipping the lampshade. The lampshade cover 1 lies flat when the intermediate supports are removed.

FIG. 3A illustrates the fully assembled lampshade of the first exemplary embodiment with all supports in place (the cover is omitted for clarity). The first exemplary embodiment discloses a lampshade having three intermediate supports. The lampshade can have more or less supports without departing from the scope of the present invention.

Figure 4A:
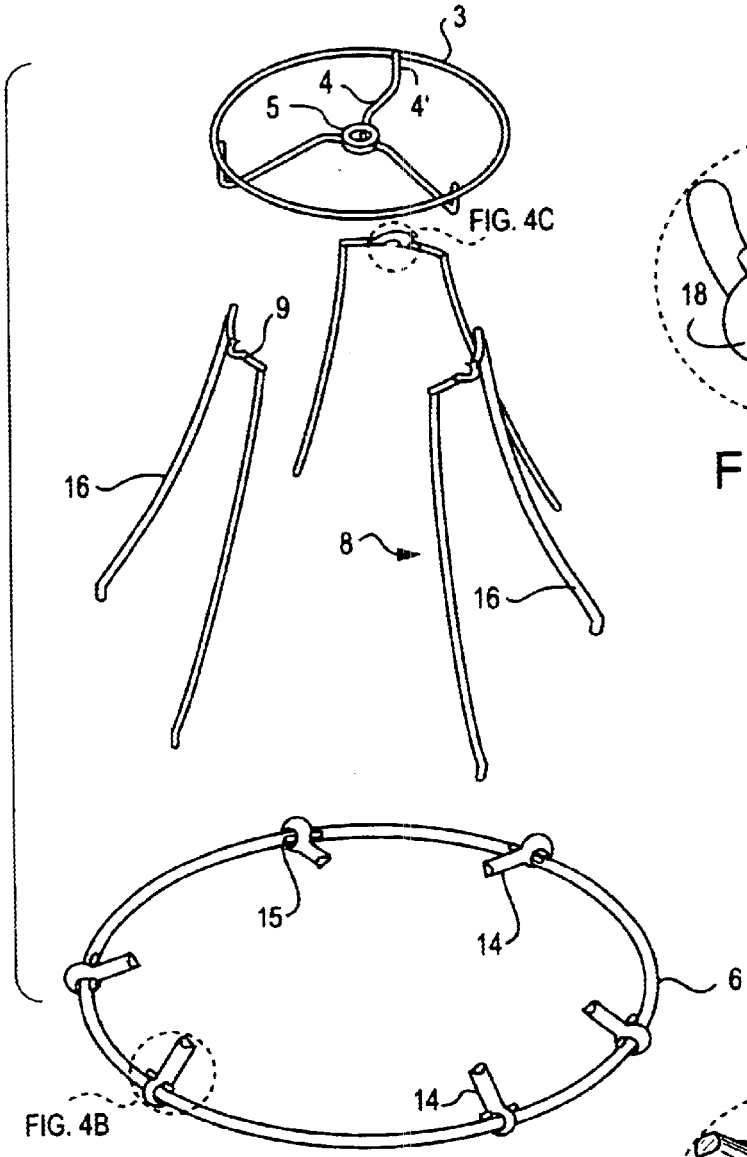
FIG. 4A is an assembly view of the structure of the second exemplary embodiment of the lampshade. The cover is omitted for clarity.
Figure 4B:
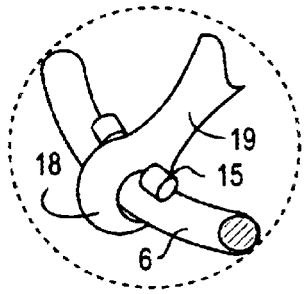
FIG. 4B is a view of the lower ring of the second exemplary embodiment with boot 14, comprised of a sleeve 18 and socket 19, and the slide stops 15.
Figure 5A:
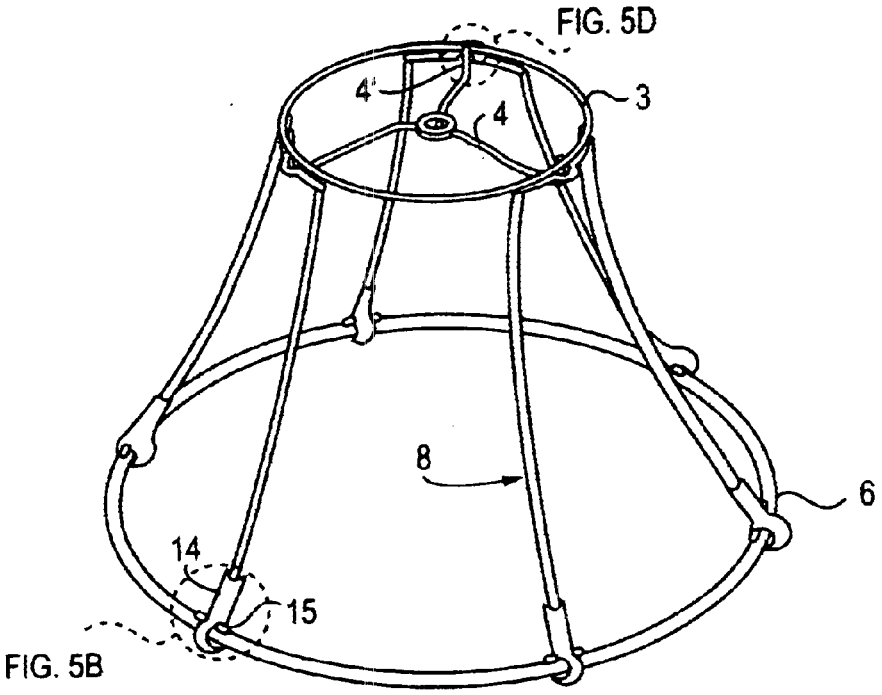
FIG. 5A is a view of the structure of the second exemplary embodiment of the lampshade fully assembled. The cover is omitted for clarity.

FIGS. 4A and 5A illustrate a second exemplary embodiment of the collapsible lampshade frame. In this embodiment, the lampshade also has a frame and a cover. As illustrated in FIGS. 4A and 5A, the frame has an upper assembly 2 comprised of upper ring 3, struts 4 and mounting hub 5, lower ring 6, boots 14 and slide stops 15, and three intermediate supports 16, each comprised of one upper circumferential yoke 9 and two vertical ribs 17. The struts 4 extend generally horizontally outward from hub 5, with a vertical portion 4' at the outer end which is connected to ring 3. The frame is preferably metal but can be made of any other suitable stiff material. The lampshade also includes a cover 1 as depicted in FIG. 1A, which can be made of any suitable flexible material such as cloth, fabric or paper. As illustrated in FIG. 1A, cover 1 is attached to upper ring 3 and lower ring 6. The mounting hub 5 is provided so that the lamp can be carried on a standard lamp base in the manner common for table lamps, floor lamps and other lamps having shades.

Figure 4C:
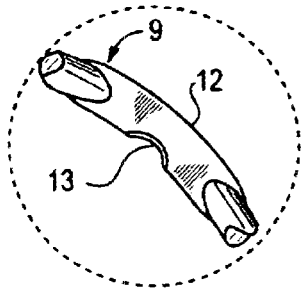
FIG. 4C is a view of the flattened portion 12 at the center of the circumferential yoke 9 with centering notch 13 of the second exemplary embodiment of the lampshade. (This view depicts the same arrangement as in FIG. 2B, but is repeated here for convenience.)

The upper circumferential yoke 9 is comprised of a bar, curved to the radius of the upper ring 3 with a portion of its length at the center 12 flattened in a plane coincident with the plane of the arc of the bar 9 itself. A notch 13 is cut into the center of the inner edge of the flattened portion 12 of the bar 9 as is shown in FIG. 4C. This notch serves as a guide for centering and then stabilizing the intermediate support 8 during assembly.

Figure 5B:
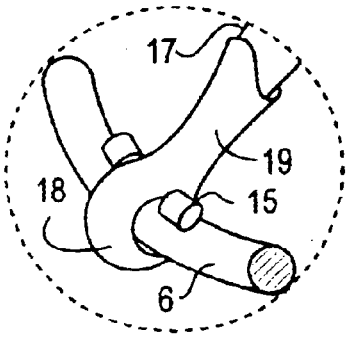
FIG. 5B is a view of the lower end of the vertical rib 17 of the intermediate support in place inside socket 19 of boot 14 of lower ring 6 after assembly of the second exemplary embodiment.
Figure 5D:
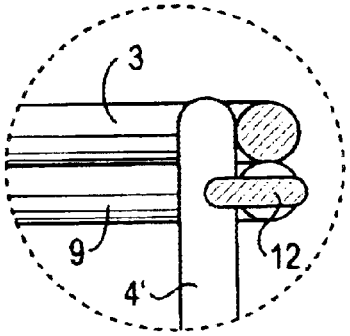
FIG. 5D is a view of the central portion 12 of the circumferential yoke 9 of the intermediate support of the second exemplary embodiment in position against the upper ring 3, held in place by the vertical portion 4' of strut 4 after assembly. (This view depicts the same arrangement as in FIG. 3C, but is repeated here for convenience.)
Figure 5C:
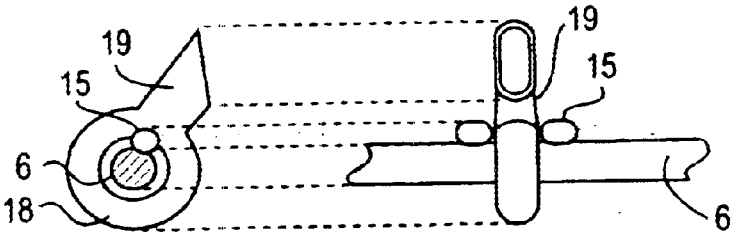
FIG. 5C is a detailed view of boot 14 showing sleeve 18, socket 19 and slide stops 15 on lower ring 6 of the second exemplary embodiment.

Boots 14 are shown in detail in FIG. 5C. Each boot 14 consists of a sleeve 18 and a socket 19. Ring 6 passes through the sleeve 18 on the boot 14 such that the boot 14 is able to rotate radially about ring 6. The socket 19 of the boot 14 is tubular in shape extending from the sleeve 18 with an open end. The open end can be cut perpendicular to the axis of the socket, or can be cut at an angle as shown in FIG. 5C.

The slide stops 15 are comprised of any suitable and suitably shaped material attached to the lower ring 6 on each side of each boot 14 such that the slide stops 15 prevent lateral movement of the boots 14.

Each of the intermediate supports 8 is U-shaped. To assemble the lampshade, each of the three intermediate supports 8 are placed in position between the upper and lower rings 3 and 6, as illustrated in FIG. 5A. To install each intermediate support 8, first the upper circumferential yoke 9 of the support is placed against the lower surface of upper ring 3, as illustrated in FIG. 5D. Next, the lower end of each of the vertical ribs 16 of each support is compressed inward and upward, toward the upper circumferential yoke 9, bowing each rib slightly to allow it to slip into socket 19 of boot 14 as illustrated in FIG. 5B. As each rib 16 is bowed, the corresponding boot 14 is rotated to permit the end of the rib to slide into the opening at the socket end 19 of the boot 14. When the rib is engaged in the boot, the bowing of the rib is released. The rib penetrates the socket of the boot causing the boot to rotate naturally to align its radial axis with the radial axis of the vertical rib. The supports and boots are held in place by the tension of the cover 1. The vertical ribs 16 of the intermediate supports 8 hold the upper and lower rings 3 and 6 parallel and spaced apart to form the frame structure for the shade. The intermediate supports 8 are not attached to either ring but are simply held in place by being wedged against the upper ring at the top and pressed into the boots 14 at the bottom. The supports are removed from the upper ring and the boots prior to collapsing and storing or shipping the lampshade. The cover 1 lies flat when the intermediate supports are removed.

FIG. 5A illustrates the fully assembled lampshade of the second exemplary embodiment with all supports in place (the cover is omitted for clarity). The second exemplary embodiment discloses a lampshade having three intermediate supports. The lampshade can have more or less supports without departing from the scope of the present invention.

Figure 6A:
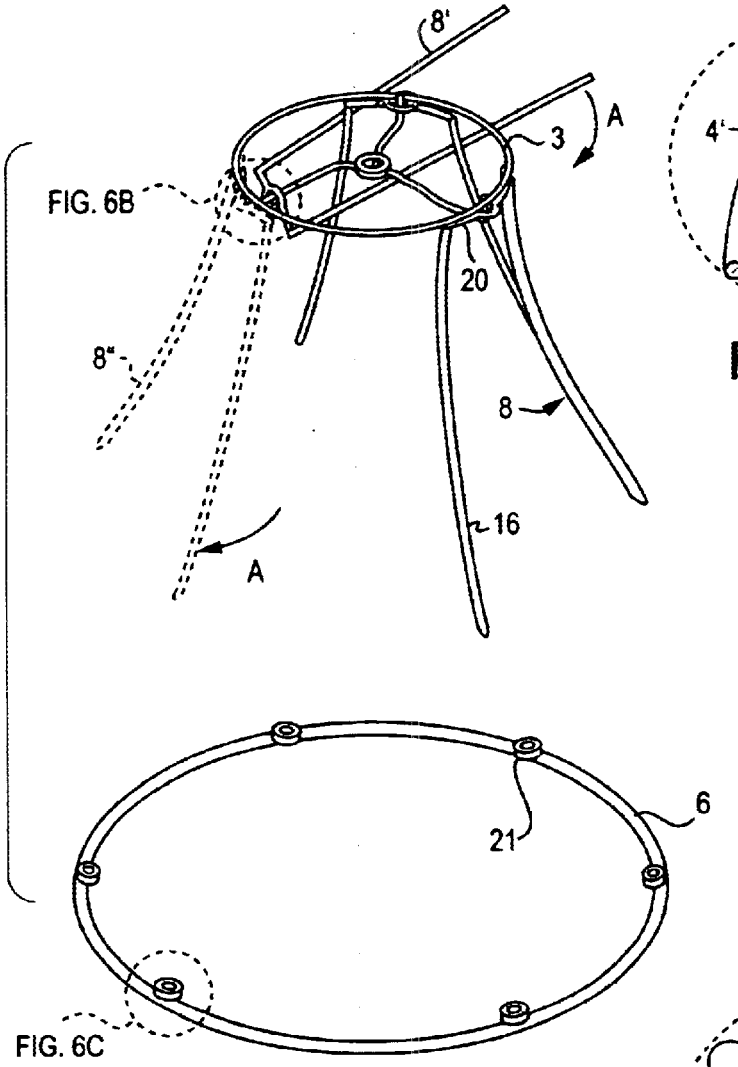
FIG. 6A is an assembly view of the structure of the third exemplary embodiment of the lampshade. The cover is omitted for clarity.
Figure 7A:
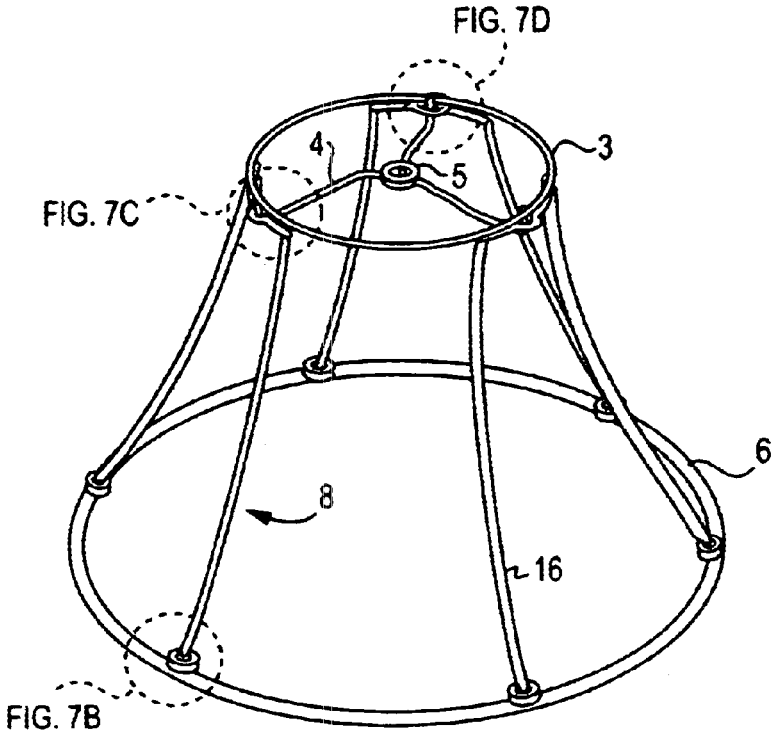
FIG. 7A a view of the structure of the third exemplary embodiment of the lampshade fully assembled. The cover is omitted for clarity.

FIGS. 6A and 7A illustrate a third exemplary embodiment of the collapsible lampshade frame. In this embodiment, the lampshade also has a frame and a cover. As illustrated in FIGS. 6A and 7A, the frame has an upper assembly A comprised of upper ring 3, three struts 4 and a mounting hub 5; a lower ring 6 with six sockets 21 and three intermediate supports 8, each comprised of an upper circumferential yoke 20 and two vertical ribs 16. The struts 4 extend generally horizontally outward from hub 5, with a vertical portion 4' at the outer end which is connected to ring 3. The intermediate supports 8 are loosely connected to the upper ring 3 by means of the vertical end 4' of each strut 4 passing through a hole in the in the flattened portion 22 of the upper circumferential yoke 20 of the intermediate support 8. The frame is preferably metal but can be made of any other suitable stiff material. The lampshade also includes a cover 1 as depicted in FIG. 1A, which can be made of any suitable flexible material such as cloth, fabric or paper. As illustrated in FIG. 1A, cover 1 is attached to upper ring 3 and lower ring 6. The mounting hub 5 is provided so that the lamp can be carried on a standard lamp base in the manner common for table lamps, floor lamps and other lamps having shades.

Figure 6B:
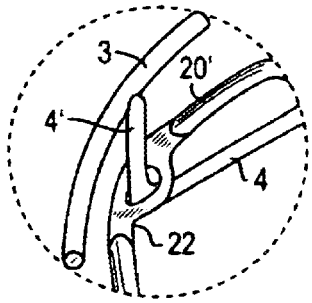
FIG. 6B is a view of the flattened portion 22 of the bar 20' of the circumferential yoke 20 of the intermediate support of the third exemplary embodiment positioned loosely on strut 4 during assembly or disassembly.

The upper circumferential yoke 20 is comprised of a bar 20', curved to the radius of the upper ring 3 with a portion of its length at the center 22 flattened in a plane coincident with the plane of the arc of the bar itself. A hole is cut through the flattened portion 22 of the bar 20' as is shown in FIG. 6B. This hole serves as a guide for centering and then stabilizing the intermediate support 8 during and after assembly, and also acts to keep support 8 connected to the shade frame when collapsed for transport and/or storage.

Figure 6C:
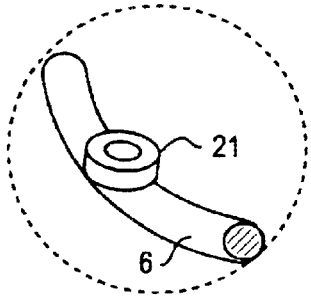
FIG. 6C is an additional side and end detailed view of socket 21 on lower ring 6 of the third exemplary embodiment.

The sockets 21 are shown in detail in FIG. 6C. Each socket 21 consists of a ring with a hole in its center attached to the upper, inner face of the lower ring 6 with one side of the hole in the socket 21 laying against the surface of the ring 6.

Figure 7B:
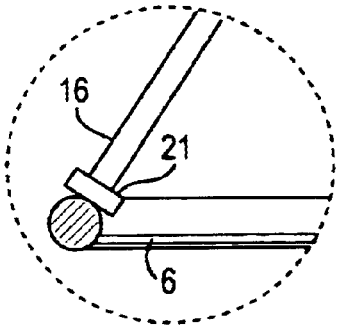
FIG. 7B is a view of the lower end of the vertical rib 16 of the intermediate support in place inside socket 21 of lower ring 6 after assembly of the third exemplary embodiment.
Figure 7D:
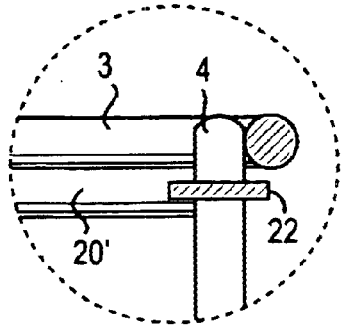
FIG. 7D is an additional view of the central portion 22 of the circumferential yoke 20 of the intermediate support of the third exemplary embodiment in position against the upper ring 3, held in place by the vertical portion 4' of strut 4 after assembly.
Figure 7C:
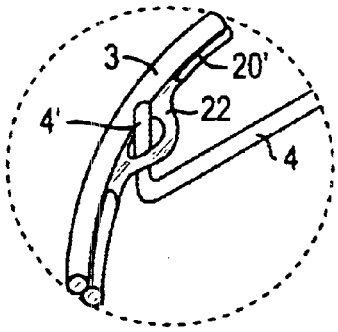
FIG. 7C is a view of the flattened portion 22 of the bar 20' of the circumferential yoke 20 of the intermediate support of the third exemplary embodiment in position against the upper ring 3, held in place by the vertical portion 4' of strut 4 after assembly.

Each of the intermediate supports 8 is U-shaped. When disassembled and collapsed for storage or transport, the supports are moved from vertical 8" to the flat position as illustrated by 8'. To assemble the lampshade, each of the three intermediate supports 8 are moved outward along its respective strut 4 and placed in position between the upper and lower rings 3 and 6, as illustrated by arrows A. To install each intermediate support, first the upper circumferential yoke 20 of the support is placed against the lower surface of upper ring 3, as illustrated in FIG. 7C. Next, the lower end of each of the vertical ribs 16 of each support 8 is compressed inward and upward, toward the upper circumferential yoke 20, bowing each rib slightly to allow it to slip into a socket 21 as illustrated in FIG. 7B. When the rib 16 is engaged in the socket 21, the rib 16 is released. The rib penetrates the hole of the socket 21 and rests against the surface of the lower ring 6. The supports are held in place by the tension of the cover 1. The vertical ribs 16 of the intermediate supports 8 hold the upper and lower rings 3 and 6 parallel and spaced apart to form the frame structure for the shade. The intermediate supports 8 are not attached to either ring 3 or 6 but are simply held in place by being wedged against the upper ring 3 at the top and pressed into the sockets 21 at the bottom. To collapse the lampshade, the supports are removed from the sockets 21 and loosened from the upper ring 3. The cover 1 is collapsed and the supports 8 are arranged to lie loosely together prior to storing or shipping the lampshade. The lampshade cover 1 and the intermediate supports 8 lie flat when the intermediate supports are loosened and arranged for storage or shipment.

FIG. 7A illustrates the fully assembled lampshade of the second exemplary embodiment with all supports in place (the cover is omitted for clarity). The third exemplary embodiment discloses a lampshade having three intermediate supports. The lampshade can have more or less supports without departing from the scope of the present invention.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A collapsible lampshade, comprising:

an upper ring;

a lower ring;

a number of removable, generally U-shaped supports having a flattened apex with a vertical notch and two legs with ends;

a cover attached to said upper and lower rings;

a mounting hub connected to said upper ring by struts, each strut having a generally horizontal portion and a generally vertical portion;

a plurality of receptacles attached to said lower ring wherein the apex of each of said generally U-shaped supports is pressed against said upper ring and each said vertical notch is aligned with said generally vertical portion of one of said struts; and each of said ends of said generally U-shaped supports is inserted into one of said receptacles.

2. The collapsible lampshade of claim 1, wherein:

said supports are press fit between said rings to space apart said rings, maintaining tension on said cover which maintains said supports in position between said rings.

3. The collapsible lampshade of claim 2, wherein:

said lampshade collapses when said supports are removed from between said rings, relieving said tension on said cover and allowing said shade to collapse to a flat configuration.

4. The collapsible lampshade of claim 1, wherein:

the apex of each U-shaped support is curved to match the curve of said upper ring.

5. A collapsible lampshade, comprising:

an upper ring;

a lower ring;

a number of removable, generally trapezoidal shaped supports; and a mounting hub connected to said upper ring by struts, each strut having a generally horizontal portion and a generally vertical portion; wherein a first end of each of said generally trapezoidal shaped supports has a flattened portion with a vertical notch and is pressed against said upper ring with said notch aligned with said vertical portion of one of said struts;

the opposite end of each of said generally trapezoidal supports is pressed against the lower ring.

6. The collapsible lampshade of claim 5, wherein:

the other two sides of each of said supports extend between and separate said upper and lower rings.

7. The collapsible lampshade of claim 6, wherein:

said supports are press fit between said rings to space apart said rings, maintaining tension on said cover which maintains said supports in position between said rings.

8. The collapsible lampshade of claim 7, wherein:

said lampshade collapses when said supports are removed from between said rings, relieving said tension on said cover and allowing said shade to collapse to a flat configuration.

9. The collapsible lampshade of claim 5, wherein:

said first end of each support is curved to match the curve of said upper ring; and said opposite end is curved to match the curve of said lower ring.

10. A collapsible lampshade frame, comprising:

an upper ring;

a lower ring;

a number of U-shaped supports movably connected to said upper ring, each support having an apex with an aperture in said apex;

a mounting hub connected to said support ring by struts; each of said struts extending through an aperture in one of said supports;

wherein said supports are movable along said struts and rotatable into position extending between and separating said upper and lower rings.

* * * * *